US008726480B2

(12) United States Patent
Shea

(10) Patent No.: US 8,726,480 B2
(45) Date of Patent: May 20, 2014

(54) METHOD OF SEPARATING A LENGTH OF SINGLE-STRAND WIRE

(75) Inventor: David H. Shea, Lake Orion, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 641 days.

(21) Appl. No.: 12/912,003

(22) Filed: Oct. 26, 2010

(65) Prior Publication Data

US 2012/0097726 A1 Apr. 26, 2012

(51) Int. Cl.
*B23K 37/00* (2006.01)

(52) U.S. Cl.
USPC ..... 29/452; 29/413; 29/417

(58) Field of Classification Search
USPC ..... 29/452, 402.19, 412, 413, 414, 415, 29/417, 426.6, 426.5
See application file for complete search history.

(56) References Cited

U.S. PATENT DOCUMENTS

| | | | | |
|---|---|---|---|---|
| 4,976,392 | A * | 12/1990 | Smith et al. | 228/102 |
| 5,054,192 | A | 10/1991 | Cray et al. | |
| 5,067,382 | A | 11/1991 | Zimmerman et al. | |
| 5,195,237 | A * | 3/1993 | Cray et al. | 29/838 |
| 6,827,248 | B2 * | 12/2004 | Farassat | 228/4.5 |

FOREIGN PATENT DOCUMENTS

| | | | |
|---|---|---|---|
| DE | 938161 | C | 1/1956 |
| DE | 2142703 | A1 | 3/1973 |
| DE | 2203913 | A1 | 8/1973 |
| WO | 2007076751 | A2 | 7/2007 |

* cited by examiner

*Primary Examiner* — David Bryant
*Assistant Examiner* — Christopher Besler
(74) *Attorney, Agent, or Firm* — Quinn Law Group, PLLC

(57) ABSTRACT

A method of separating a length of single-strand wire at a notch location includes forming at least one notch in the length of single-strand wire at the notch location. The notch location is subjected to tensile strain until the notch location ruptures at the notch to separate the length of single-strand wire into a first single-strand wire and a second single-strand wire. After separation of the length of single-strand wire, the first and second single-strands each present a generally tapered end that corresponds to the notch location.

19 Claims, 7 Drawing Sheets

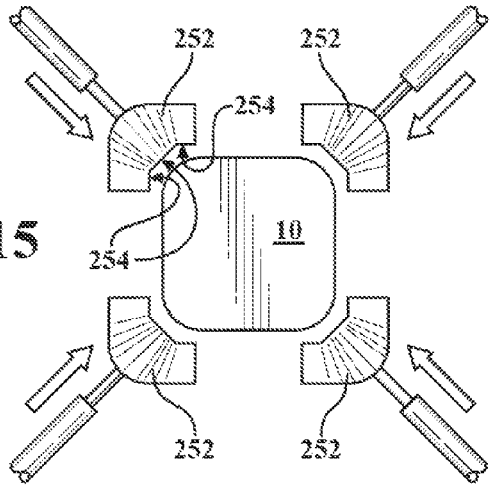
FIG. 15
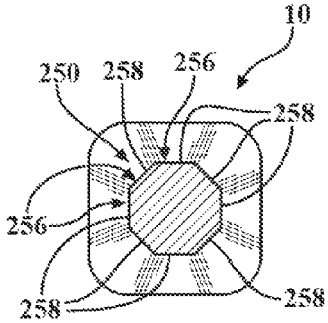
FIG. 17
FIG. 16
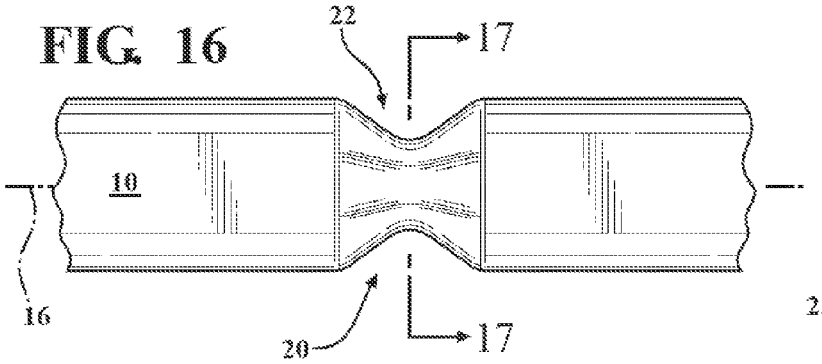
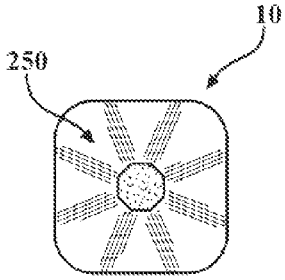
FIG. 19
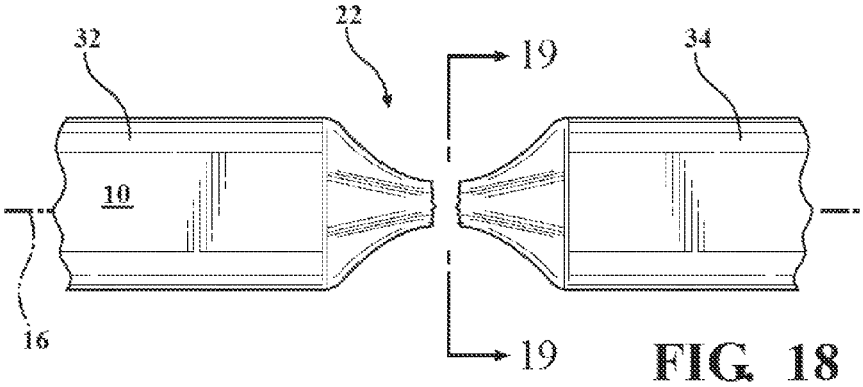
FIG. 18

METHOD OF SEPARATING A LENGTH OF SINGLE-STRAND WIRE

TECHNICAL FIELD

The present invention relates to a method of separating a length of single-strand wire.

BACKGROUND OF THE INVENTION

Electric machines, such as an electric motor, include a stator and a rotor having opposing surfaces. The stator includes a plurality of slots disposed on a surface of the stator and a paper sleeve is inserted within each of the slots of the stator. A plurality of conducting wires are disposed within the paper sleeves that are disposed within the slots of the stator. The rotor is rotatable about an axis relative to the stator. The conducting wires generate an electromagnetic force in response to an electric current passing therethrough. The electromagnetic force acts against the rotor to cause the rotor to rotate relative to the stator.

SUMMARY OF THE INVENTION

Accordingly, a method of separating a length of single-strand wire at a notch location is provided that includes forming at least one notch in the wire strand at the notch location. The notch location is subjected to tensile strain until the notch location ruptures at the at least one notch to separate the wire strand into a first single-strand wire and a second single-strand wire. After separation of the wire strand, the first and second single-strand wires each present a generally tapered end that corresponds to the notch location.

Additionally, a method of separating a length of single-strand wire at a notch location is provided that includes inserting the single-strand wire into a die block and moving at least one punch relative to the die block to form at least one notch in the length of single-strand wire at the notch location. The notch location is subjected to tensile strain until the notch location ruptures at the at least one notch to separate the length of single-strand wire into a first single-strand wire and a second single-strand wire. After separation of the length of single-strand wire, the first single-strand wire and the second single-strand wire each present a generally tapered end that corresponds to the notch location.

In another aspect, a method of separating a length of single-strand wire at a notch location is provided that includes inserting the length of single-strand wire into a first block portion and a second block portion of a die block such that the length of single-strand wire extends along a first axis and moving at least one punch relative to the first block portion and the second block portion along a second axis to form at least one notch in the length of single-strand wire at the notch location that is offset from the first axis. The length of single-strand wire is restrained relative to each of the first block portion and the second block portion. At least one of the first die block portion and the second die block portion is moved along the first axis in opposition to the other of the first die block portion and the second die block portion such that the notch location is subjected to tensile strain. After separation of the length of single-strand wire, the first and second single-strand wires each present a generally tapered end corresponding to the notch location.

The above features and advantages and other features and advantages of the present invention are readily apparent from the following detailed description of the best modes for carrying out the invention when taken in connection with the accompanying drawings.

BRIEF DESCRIPTION OF THE DRAWINGS

FIG. 15 is a schematic illustration of an end view of the length of single-strand wire, in an alternative embodiment, being radially compressed to form a notch;

FIG. 16 is a schematic illustration of a side view of the single-strand wire of FIG. 15 showing the notch after being radially compressed;

FIG. 17 is a schematic illustration of a cross-sectional end view of the notch in FIG. 16, after being radially compressed, taken along line 17-17;

FIG. 18 is a schematic illustration of a side view of the single-strand wire after being tensily separated to form a first strand and a second strand; and FIG. 19 is a schematic illustration of an end view of the notch in FIG. 18 after being tensily separated, taken along line 19-19.

DESCRIPTION OF THE PREFERRED EMBODIMENTS

Figure 1:
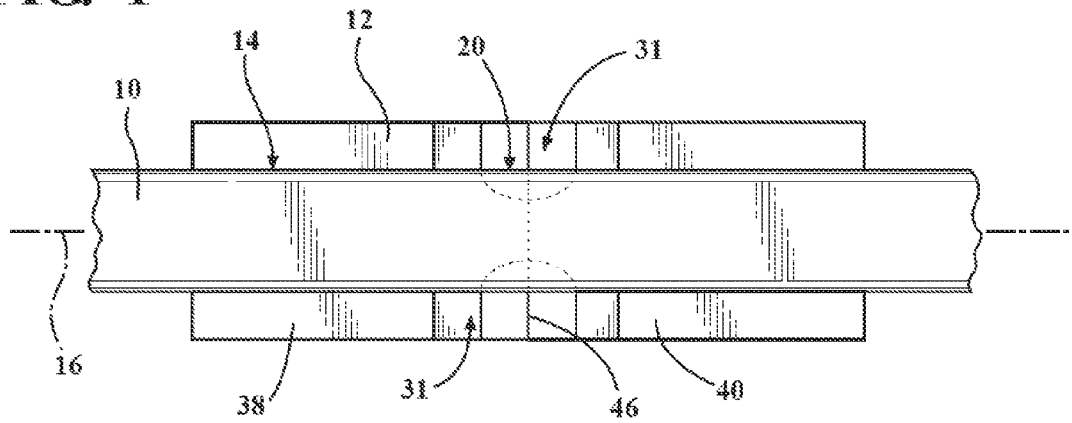
FIG. 1 is a schematic illustration of a top view of a length of single-strand wire positioned over punches and in a groove of a die block.

Referring to the drawings, wherein like reference numbers correspond to like or similar components throughout the several figures, FIG. 1 shows a length of single-strand wire 10 disposed in a die block 12. The length of single-strand wire 10 may be a composite material strand, i.e., silver plated copper. Also, the length of single-strand wire 10 may be a solid core wire material strand that may be formed from copper, a copper alloy, or any other deformable material known to those skilled in the art. The die block 12 defines a groove 14 configured for supporting a length of the single-strand wire 10 along a first axis 16. The groove 14 may be configured for supporting a length of single-strand wire 10 having a cross-section that is circular, square, rectangular, or any other desired shape known to those skilled in the art. The die block 12 supports the length of single-strand wire 10 at a notch location 20 (shown in FIGS. 2-9) as at least one notch 22 is formed in a portion of the length of single-strand wire 10.

Figure 2:
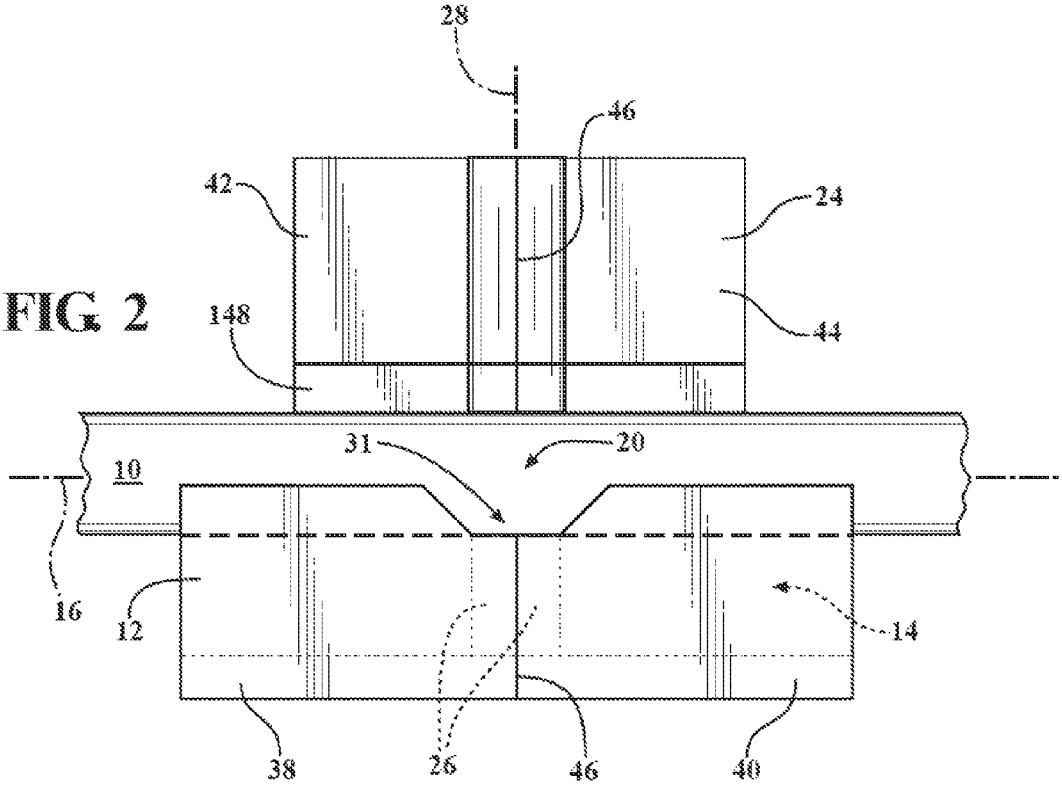
FIG. 2 is a schematic illustration of a side view of the length of single-strand wire disposed over the punches and in the groove of the die block with a punch block covering the die block to form notches in the length of single-strand wire.
Figure 3:
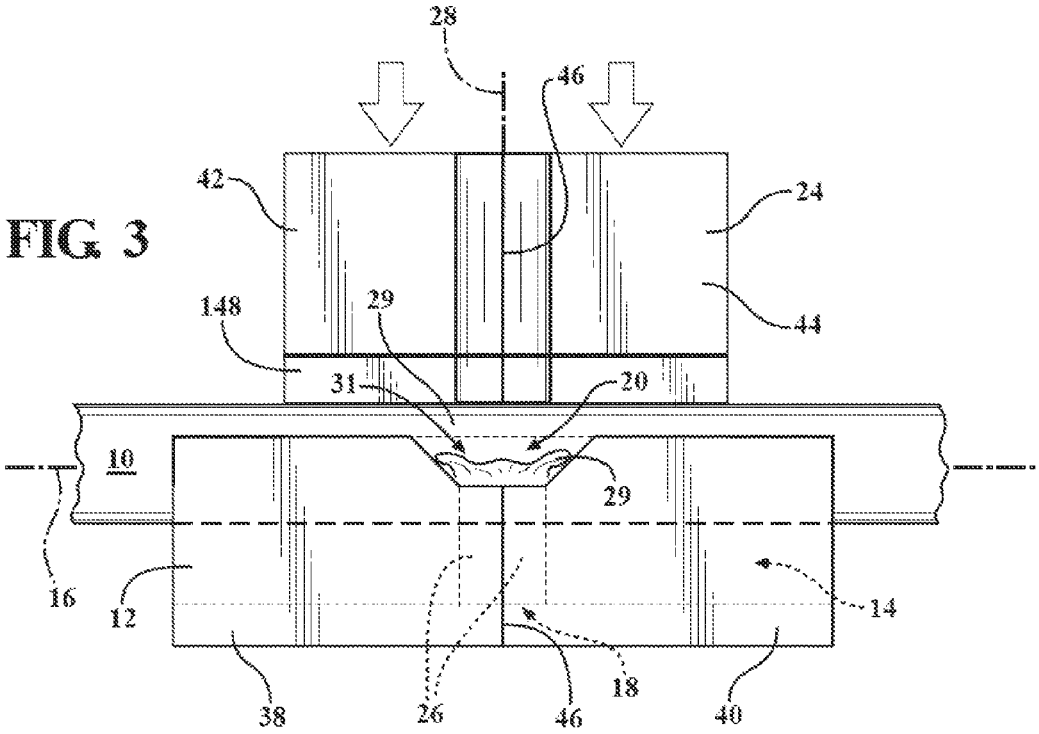
FIG. 3 is a schematic illustration of a side view of the punch block pressing the length of single-strand wire to be partially disposed within the groove such that material from the wire is removed by the punches.

Referring to FIG. 2, a punch block 24 is configured to move in generally perpendicular relationship to the first axis 16. Referring to FIGS. 2 and 3, the die block 12 includes at least one punch 26 formed within the groove 14 of the die block 12. The punch block 24 moves to force the length of single-strand wire 10 along the second axis 28 toward the groove 14, until the notch locations 20 contact the punches 26. As the punch block continues to press the length of single-strand wire 10, material 29 is removed from the notch locations 20 by the punches 26 until the length of single-strand wire is disposed in the groove 14 and notches 22 are formed therein, as shown in FIGS. 2-8. Therefore, the punches 26 remove material 29 from the single-strand wire 10 to form notches 22 at the corresponding notch locations 20. A relief 31 may be formed into opposing sides of the die block 12 to allow the material 29 to escape the die block 12 and otherwise prevent build-up within the die block 12.

Figure 4:
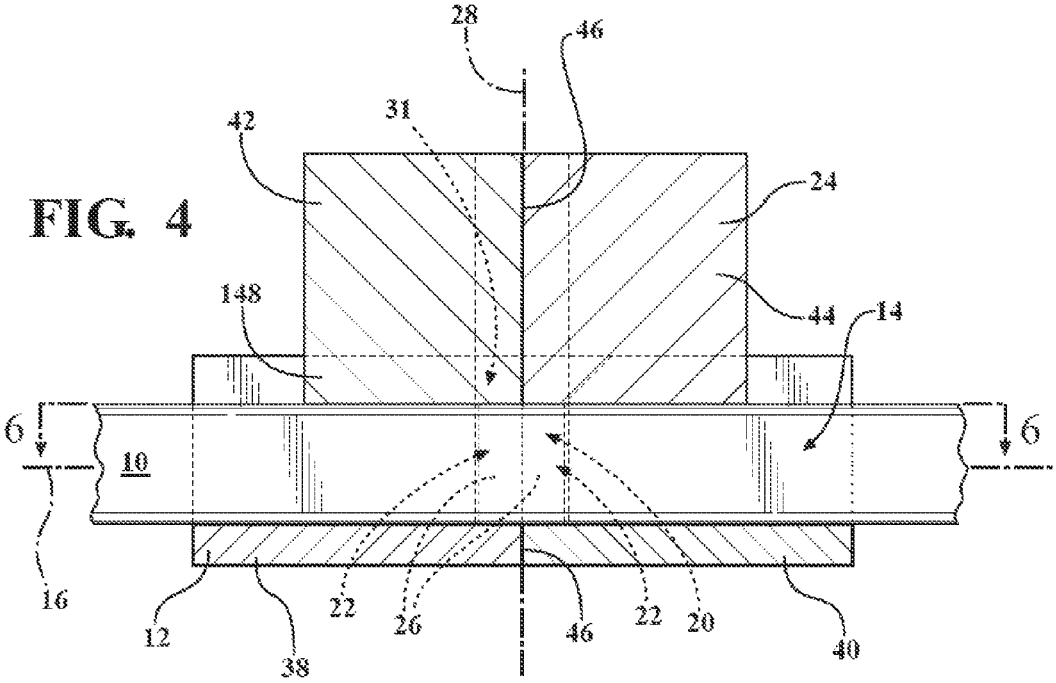
FIG. 4 is a schematic illustration of a cross-sectional side view of the punch block pressing the length of single-strand wire completely within the groove such that notches are formed in the wire.

Referring specifically to FIG. 4, the die block 12 includes at least two punches 26 that extend from the die block 12 in spaced and generally parallel relationship to one another. The punches 26 are configured to form a pair of opposed notches 22 in the length of single-strand wire 10 at the corresponding notch location 20. The notches 22 may be symmetrically opposed or non-symmetrically opposed. Therefore, each of the corresponding notches 22 is offset from the first axis 16. The importance of positioning the notches 22 with respect to one another will be described in more detail below.

Figure 6:
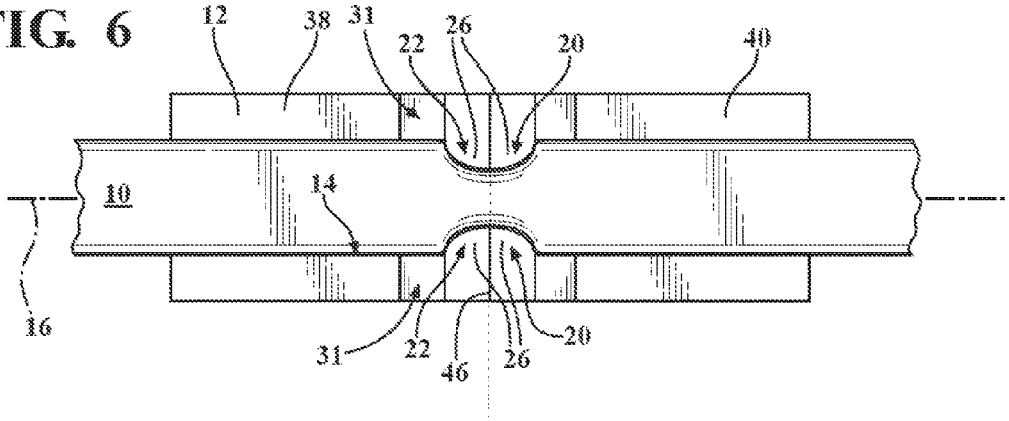
FIG. 6 is a schematic illustration of a top view of the length of single-strand wire and the die block of FIG. 4 with notches formed in the wire, taken along line 6-6.

Referring to FIGS. 4 and 6, the notches 22 may be formed as a half-circle. It should be appreciated, however, that the notches 22 may also be V-shaped or any other suitable shape known to those skilled in the art.

Figure 7:
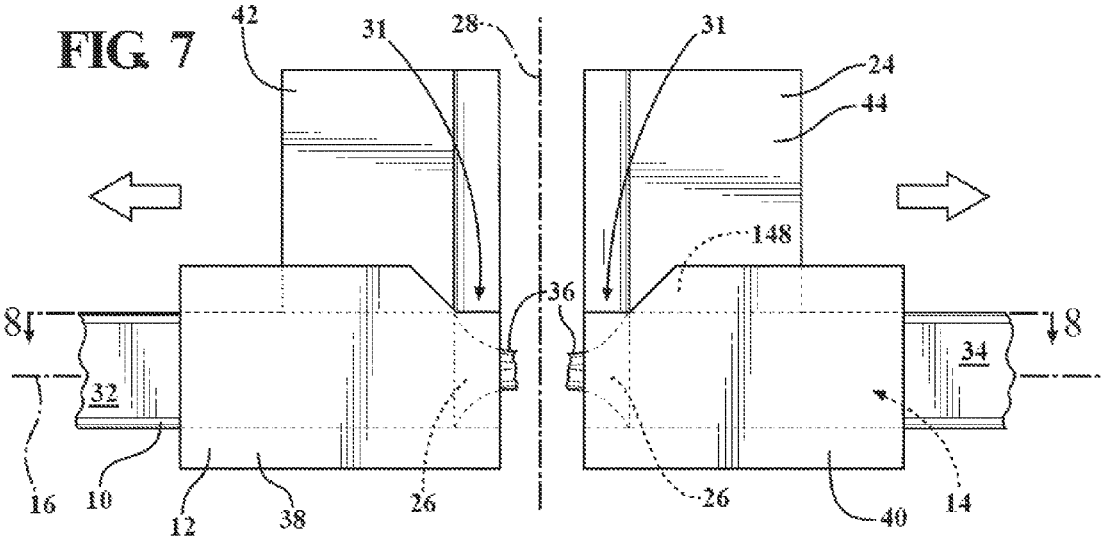
FIG. 7 is a schematic illustration of a side view of the length of single-strand wire separated into a first single-strand wire and a second single-strand wire as a result of a first die and punch block portion separating from a second die and punch block portion, along a first axis.
Figure 8:
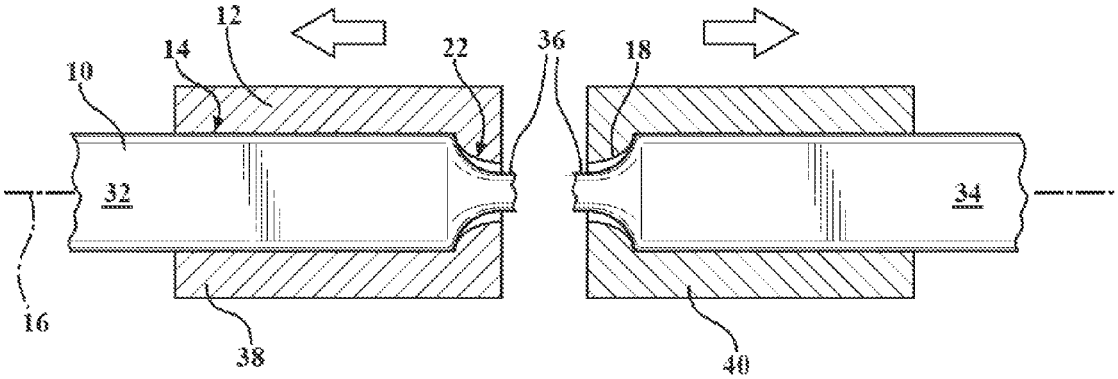
FIG. 8 is a schematic illustration of a cross-sectional top view of the first and second single-strand wires in the respective first and second die block portions of FIG. 7, taken along line 8-8.
Figure 9:
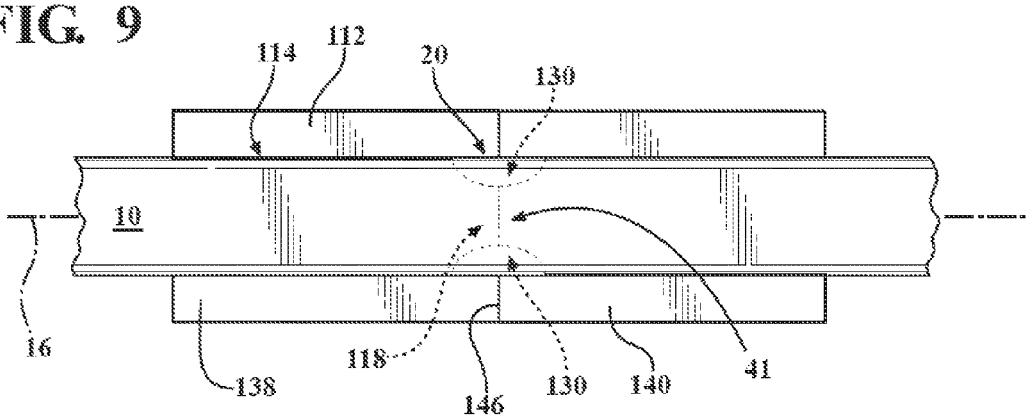
FIG. 9 is a schematic illustration of a top view of a length of single-strand wire disposed within a groove of a die block.

After the notches 22 are formed at the notch location 20, a cross-sectional area of the length of single-strand wire 10 at the notch location 20 is less than a cross-sectional area of the length of single-strand wire 10 in a location of the length of single-strand wire 10 that is free of the notches 22, as illustrated in FIG. 6. After the notches 22 are formed, the notch location 20 is subjected to tensile strain along the first axis 16 until the notch location 20 ruptures, as shown in FIGS. 7 and 8. Once the notch location 20 ruptures, the length of single-strand wire 10 separates at the notch 22 of the notch location 20 into a first single-strand wire 32 and a second single-strand wire 34. After separation of the length of single-strand wire 10, the first single-strand wire 32 and the second single-strand wire 34 each present a generally tapered end 36 that corresponds to the notch location 20. As the notch location 20 of the length of single-strand wire 10 is subjected to the tensile strain, the cross-sectional area at the notches 22 further decreases, by virtue of the Poisson effect, until the length of single-strand wire 10 ultimately ruptures to provide the first single-strand wire 32 and the second single-strand wire 34, as shown in FIGS. 7 and 8.

Referring again to FIGS. 2-8, the separation of the first single-strand wire 32 from the second single-strand wire 34 may optionally be performed while the wire strand is still within the die block 12 and the punch block 24. More specifically, the die block 12 may be formed as a first die block portion 38 and a second die block portion 40, as shown in FIGS. 1-4 and 6-8. Likewise, the punch block 24 may be formed as a first punch block portion 42 and a second punch block portion 44, as shown in FIGS. 2, 4, and 7. A parting line 46 is defined between the respective block portions of the die block 12 and the punch block 24, proximate the notching portion. The parting lines 46 define the line of separation between the first die and punch block portions 38, 42 and the corresponding second die and punch block portions 40, 44. The first die and punch block portions 38, 42 are movable along the first axis 16 in opposition to the respective second die and punch block portions 40, 44.

Figure 5:
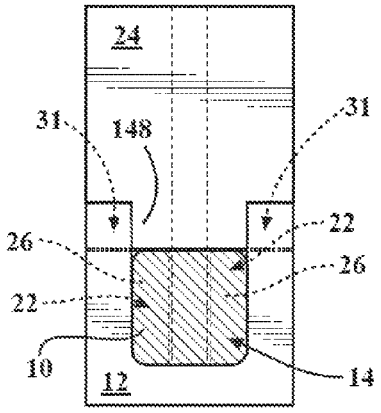
FIG. 5 is a schematic illustration of an end view of the length of single-strand wire of FIG. 4.

The notched length of single-strand wire 10 may be retained between the respective first die and punch block portions 38, 42 and the second die and punch block portions 40, 44. Referring to FIGS. 2, 3, and 5, the first and second punch block portions 42, 44 apply pressure to the length of single-strand wire 10 to retain the notched length of single-strand wire 10 relative to the first and second die block portions 38, 40. It should be appreciated that the length of single-strand wire 10 may be also be retained relative to the respective first and second die and punch block portions 38, 40, 42, 44 using any other method. As the first die and punch block portions 38, 42 and the second die and punch block portions 40, 44 move in opposition to one another along the first axis 16 relative to one another, the notch location 20 is subjected to tensile strain until the notches 22 rupture at the notch location 20, as shown in FIGS. 7 and 8. As described above, once the notch location 20 ruptures, the length of single-strand wire 10 separates into the first and second single-strand wire 32, 34 that each present a generally tapered end 36 that correspond to the notch location 20. For electric machines with heavy gauge wire, the "bar-wound" method of construction may be used to create "coils", and this necessitates inserting the wire strands 32, 34 into narrow slots (not shown). The tapered end 36 allows the wire strands 32, 34 to be easily inserted into the narrow slots.

Alternatively, the length of single-strand wire 10 may be separated into the first and second single-strand wire 32, 34 outside of the die block 12 and punch block 24. For example, the notched length of single-strand wire 10 is removed from the die block 12 and punch block 24. Next, the first single-strand wire 32 and the second single-strand wire 34 are each grasped or otherwise restrained. Then, the length of single-strand wire 10 is subjected to tensile strain until the notches 22 rupture at the notch location 20 and the first single-strand wire 32 separates from the second single-strand wire 34 that each present a generally tapered end 36 that corresponds to the notch location 20. The shape of the generally tapered end 36 may vary based on whether the notches 22 are symmetrically opposed or non-symmetrically opposed to one another. For example, as illustrated in FIG. 6, the notches 22 are symmetrically opposed to one another, which results in a generally tapered end 36 also being symmetrical in shape. Alternatively, notches 22 that are not symmetrically opposed to one another (not shown) results in a generally tapered end 36 that is non-symmetrical in shape.

Figure 10:
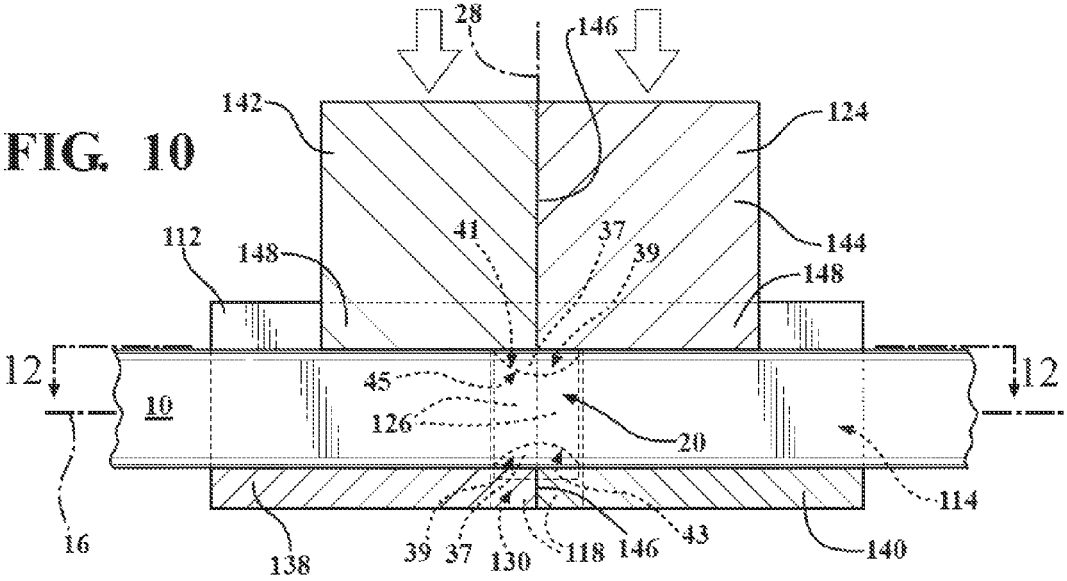
FIG. 10 is a schematic illustration of a cross-sectional side view of the length of single-strand wire disposed within the groove of the die block with a punch block covering the die block to form notches in the length of single-strand wire.
Figure 11:
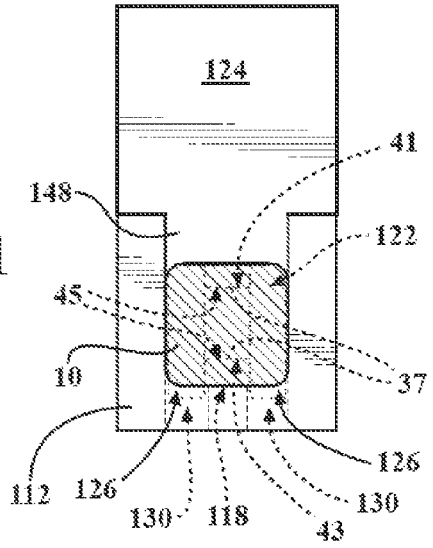
FIG. 11 is a schematic illustration of an end view of the length of single-strand wire of FIG. 10.

Referring to the embodiment shown in FIGS. 9-14, an alternative configuration of separating the single-strand wire 10 is shown. Referring specifically to FIG. 10, a punch block 124 is configured to move in generally perpendicular relationship to the first axis 16. Referring to FIGS. 10 and 11, the punch block 124 includes at least one punch 126 that is configured to move along a second axis 28 and extend into the groove 114 of the die block 112. The second axis 28 extends in perpendicular and spaced relationship to the first axis 16 such that the second axis 28 does not intersect with the first axis 16. Accordingly, the punch 126 is configured to move along the second axis 28, through a portion of the length of single-strand wire 10 at the notch location 20 that is spaced or offset from the first axis 16. As the punch 126 passes through the length of single-strand wire 10, the punch 126 removes material to form at least one notch 22 at the notch location 20 that is offset from the first axis.

The punch block 124 includes at least one punch 126. More specifically, referring specifically to FIG. 11, the punch block 124 includes two punches 126 that extend from the punch block 124 in spaced and generally parallel relationship to one another. The punches 126 are configured to form a pair of opposed notches 22 in the length of single-strand wire 10 at the notch location 20. It should be appreciated that any desired number of punches 126 may be used, as known to those skilled in the art. The notches 22 may be symmetrically opposed or non-symmetrically opposed. Therefore, each of the corresponding notches 22 is offset from the first axis 16. The importance of positioning the notches 22 with respect to one another will be described in more detail below. The die block 112 includes a support 118 and a pair of reliefs 130 are defined in the die block 112 such that the support 118 is between the pair of reliefs 130. The reliefs 130 are configured to receive a portion of the corresponding punch 126 of the punch block 124. The support 118 is configured to capture and support the notched length of single-strand wire 10 at the notch location 20 as the punches 126 form notches in the length of single-strand wire 10.

Figure 12:
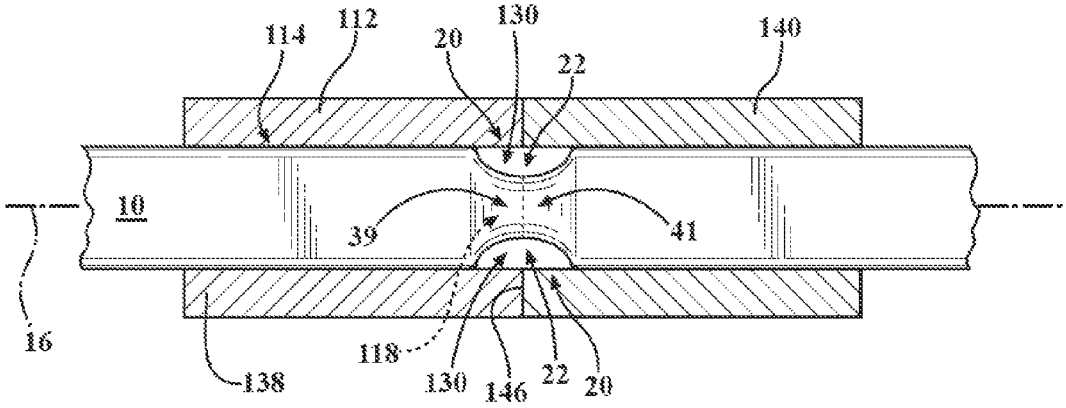
FIG. 12 is a schematic illustration of a cross-sectional top view of the length of single-strand wire and the die block of FIG. 10, taken along line 12-12.
Figure 14:
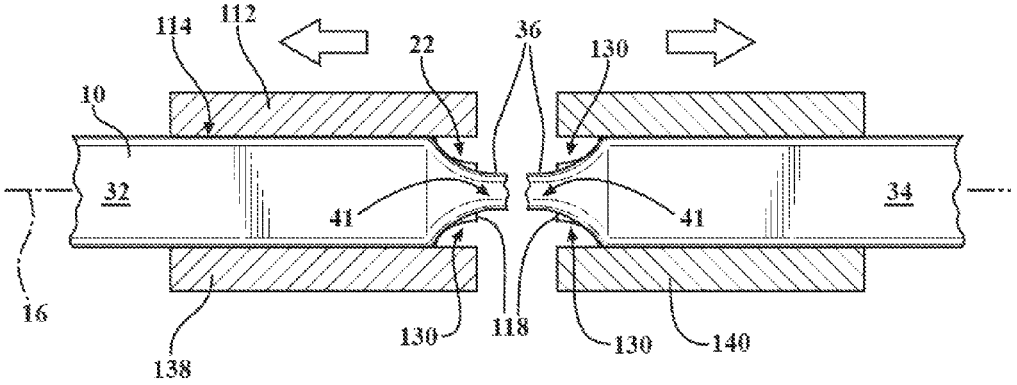
FIG. 14 is a schematic illustration of a cross-sectional top view of the first and second single-strand wires in the respective first and second die block portions of FIG. 13, taken along line 14-14.

Referring to FIGS. 12 and 14, the notches 22 may be formed as a half-circle. It should be appreciated, however, that the notches 22 may also be V-shaped or any other suitable shape.

After the notches 22 are formed at the notch location 20, a cross-sectional area of the length of single-strand wire 10 at the notch location 20 is less than a cross-sectional area of the length of single-strand wire 10 in a location of the length of single-strand wire 10 that is free of the notches 22. After the notches 22 are formed, the notch location 20 is subjected to tensile strain along the first axis 16 until the notch location 20 ruptures. Once the notch location 20 ruptures, the length of single-strand wire 10 separates at the notch 22 of the notch location 20 into a first single-strand wire 32 and a second single-strand wire 34. After separation of the length of single-strand wire 10, the first single-strand wire 32 and the second single-strand wire 34 each present a generally tapered end 36 that corresponds to the notch location 20. As the notch location 20 of the length of single-strand wire 10 is subjected to the tensile strain, the cross-sectional area at the notches 22 further decreases, by virtue of the Poisson effect, until the length of single-strand wire 10 ultimately ruptures to provide the first single-strand wire 32 and the second single-strand wire 34, as shown in FIGS. 7, 8, 13, and 14.

Figure 13:
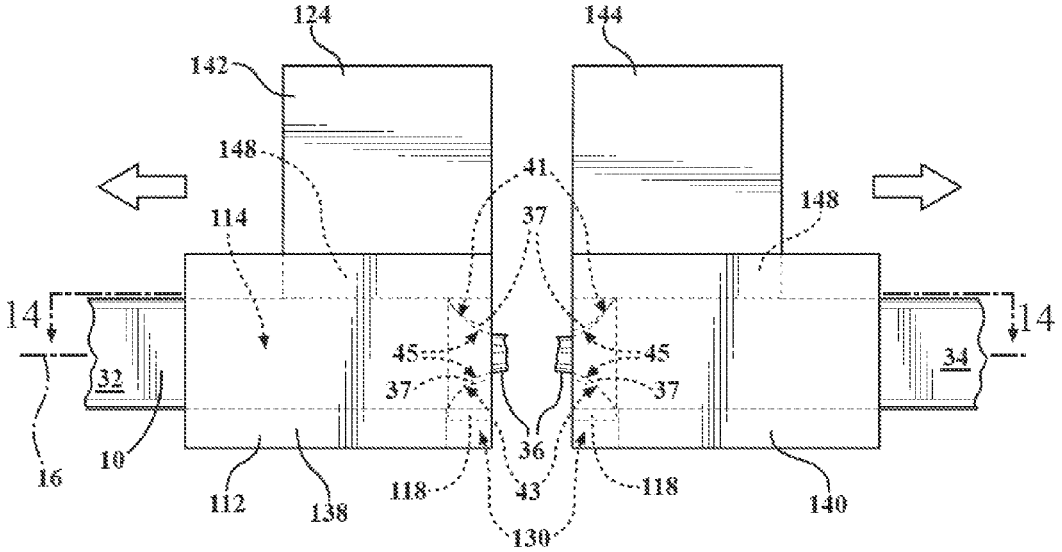
FIG. 13 is a schematic illustration of a side view of the length of single-strand wire separated into a first single-strand wire and a second single-strand wire as a result of a first die and punch block portion separating from a second die and punch block portion, along a first axis.

Referring to FIGS. 9-14, the separation of the first single-strand wire 32 from the second single-strand wire 34 may optionally be performed within the die block 112 and the punch block 124. More specifically, the die block 112 may be formed as a first die block portion 138 and a second die block portion 140, as shown in FIGS. 9, 10, and 12-14. Likewise, the punch block 124 may be formed as a first punch block portion 142 and a second punch block portion 144, as shown in FIGS. 10 and 13. A parting line 146 is defined between the respective block portions of the die block 112 and the punch block 124, proximate the notching portion. The parting lines 146 define the line of separation between the first die and punch block portions 138, 142 and the corresponding second die and punch block portions 140, 144. The first die and punch block portions 138, 142 are movable along the first axis 16 in opposition to the respective second die and punch block portions 140, 144.

The notched length of single-strand wire 10 may be retained between the respective first die and punch block portions 138, 142 and the second die and punch block portions 140, 144. Referring to FIGS. 10, 11, and 13, the punch block 124 includes a pair of retainers 148 that apply pressure to the length of single-strand wire 10 on opposing sides of the notch location 20 to retain the notched length of single-strand wire 10. More specifically, the retainers 148 extend from the respective first and second punch block portions 142, 144 and into the groove 114 to apply pressure to the length of single-strand wire 10. It should be appreciated that the length of single-strand wire 10 may be also be retained relative to the respective first and second die and punch block portions 138, 140, 142, 144 using any other method, as known to those skilled in the art. As the first die and punch block portions 138, 142 and the second die and punch block portions 140, 144 move in opposition to one another along the first axis 16 relative to one another, the notch location 20 is subjected to tensile strain until the notches 22 rupture at the notch location 20, as shown in FIGS. 13 and 14. As described above, once the notch location 20 ruptures, the length of single-strand wire 10 separates into the first and second single-strand wire 32, 34 that each present a generally tapered end 36 that correspond to the notch location 20.

Referring again to the embodiment shown in FIGS. 9-14, the die block 112 and punch block 124 may also include a coining protrusion 37 that extends into the groove 114. The coining protrusions 37 are configured to form an indentation within top and bottom surfaces 41, 43 of the single-strand wire 10, at the notch location 20, as the punch block 124 moves toward the die block 112 to form the notches 22. The indentations on the top and bottom surfaces 41, 43 of the single-strand wire 10 are "coined" or otherwise indented to match the shape of a corresponding surface 45 of the respective coining protrusions 37. In the embodiment of FIGS. 9-14, the surface 45 of the coining protrusions 37 is arcuate, to form a semi-circle in the corresponding top and bottom surfaces 41, 43 of the single-strand wire 10. It should be appreciated that the shape of the surfaces of the coining protrusions 37 may be of any desired shape, known to those skilled in the art. Additionally, there may be more or less coining protrusions 37.

Referring to the embodiment shown in FIGS. 15-19, an alternative configuration of forming the notch in the single-strand wire 10 is shown. In this embodiment, the notch 22 may be formed to have an octagonal cross-section, as illustrated at 250 in FIG. 17. The octagonal cross-section 250 may be formed by axially compressing the single-strand wire 10 with a plurality of dies 252, as illustrated in FIG. 15. FIG. 15 illustrates four dies 252 that move radially inward toward the single-strand wire 10 to form the notch 22 having the octagonal cross-section 250. Each of the dies 252 presents three surfaces 254 that are configured to form a corresponding shape in the respective notch location of the single-strand wire 10. As the dies 252 are moved radially inward toward the notch location 20 of the single-strand wire 10, the dies 252 compress the notch location 20 to compress the material and form a notch 22 having eight sides 258. Therefore, the cross-sectional area 250 at the notch 22 at the octagonal cross-section 250 is less than the cross-sectional area of the single-strand wire 10 that has not been compressed, as illustrated in FIG. 17. Referring to FIGS. 18 and 19, as the notch location 20 of the length of single-strand wire 10 is subjected to the tensile strain, the cross-sectional area at the notch 22 further decreases, by virtue of the Poisson effect, until the length of single-strand wire 10 ultimately ruptures to provide the first single-strand wire 32 and the second single-strand wire 34, as shown in FIG. 18. After the length of single-strand wire 10 ruptures to form the first and second single-strand wires 32, 34, as illustrated in FIG. 17, a cross-sectional area of the octagonal cross-section 260 at the notch 22 is further reduced from the cross-sectional area of the octagonal cross-section 250 of the un-ruptured wire 10. It should be appreciated that this embodiment may be more or less dies that provide a notch having more or less sides than that described herein.

It should also be appreciated that other dies may be used to provide a notch in the length of single-strand wire 10 at high volume, such as a rotary (or circular) die, under which the length of single-strand wire runs along the first axis 16, perpendicular to an axis of the rotary die, and a rolling action of the die would bring notching elements, presented on the rotary die, to bear on the notch location of the single-strand wire 10 to form a notch therein.

Additionally, the length of single-strand wire 10 may also undergo a stripping operation, at and axially adjacent to the notch location 20, prior to formation of the notches 22. This process may be performed in a separate die, or in the same die block 12, 112 and/or punch block 24, 124 where the notches 22 are formed. The stripping operation removes insulation, such as varnish, that coats the length of single-strand wire 10.

While the best modes for carrying out the invention have been described in detail, those familiar with the art to which this invention relates will recognize various alternative designs and embodiments for practicing the invention within the scope of the appended claims.

The invention claimed is:

1. A method of separating a length of single-strand wire at a notch location to form a first single-strand wire and a second single-strand wire, the method comprising:

forming at least one notch in the length of single-strand wire at the notch location;

subjecting the notch location to tensile strain until the notch location ruptures at the at least one notch to separate the length of single-strand wire into the first single-strand wire and the second single-strand wire;

wherein after separation of the length of single-strand wire, the first single-strand wire and the second single-strand wire each present a generally tapered end corresponding to the notch location.

2. A method of separating a length of single-strand wire, as set forth in claim 1, wherein forming at least one notch is further defined as forming a pair of notches in the length of single-strand wire at the notch location.

3. A method of separating a length of single-strand wire, as set forth in claim 2, wherein each of the pair of notches are symmetrically opposed to one another.

4. A method of separating a length of single-strand wire, as set forth in claim 1, wherein forming at least one notch is further defined as forming at least four notches, symmetrically spaced from one another about the axis.

5. A method of separating a length of single-strand wire, as set forth in claim 1, wherein forming at least one notch is further defined as forming at least one semi-circular notch in the length of single-strand wire at the notch location.

6. A method of separating a length of single-strand wire, as set forth in claim 1, wherein the length of single-strand wire extends along a first axis and the at least one notch is formed along a second axis that extends in generally perpendicular relationship to the first axis;

wherein the second axis is offset from the first axis.

7. A method of separating a length of single-strand wire at a notch location to form a first and a second single-strand wire, the method comprising:

inserting the length of single-strand wire into a die block such that the length of single strand wire is along a first axis;

moving at least one punch relative to the die block to form at least one notch in the length of single-strand wire at the notch location;

subjecting the notch location to tensile strain until the notch location ruptures at the at least one notch to separate the length of single-strand wire into the first single-strand wire and the second single-strand wire;

wherein after separation of the length of single-strand wire, the first and second single-strand wires each present a generally tapered end corresponding to the notch location.

8. A method of separating a length of single-strand wire, as set forth in claim 7, wherein moving the at least one punch is further defined as moving a pair of punches relative to the die block to form a pair of notches in the length of single-strand wire at the notch location; and wherein subjecting the notch location to tensile strain is further defined as subjecting the notch location to tensile strain until the notch location ruptures at the pair of notches to separate the length of single-strand wire into a first single-strand wire and a second single-strand wire.

9. A method of separating a length of single-strand wire, as set forth in claim 8, wherein each of the pair of punches are symmetrically opposed to one another; and wherein each of the pair of notches are symmetrically opposed to one another.

10. A method of separating a length of single-strand wire, as set forth in claim 7, wherein moving at least one punch relative to the die block to form at least one notch in the length of single-strand wire at the notch location is further defined as moving at least two punches to form at least four notches about the first axis.

11. A method of separating a length of single-strand wire, as set forth in claim 7, wherein forming at least one notch is further defined as forming at least one semi-circular notch in the length of single-strand wire at the notch location.

12. A method of separating a length of single-strand wire, as set forth in claim 7, wherein the length of single-strand wire extends along the first axis and the at least one notch is formed along a second axis that extends in generally perpendicular relationship to the first axis;

wherein the second axis is offset from the first axis.

13. A method of separating a length of single-strand wire at a notch location into a first and a second single-strand wire, the method comprising:

inserting the length of single-strand wire into a first block portion and a second block portion of a die block such that the length of single-strand wire extends along a first axis;

moving at least one punch relative to the first block portion and the second block portion along a second axis to form at least one notch in the length of single-strand wire at the notch location that is offset from the first axis;

restraining the length of single-strand wire relative to each of the first block portion and the second block portion;

moving at least one of the first die block portion and the second die block portion along the first axis in opposition to the other of the first die block portion and the second die block portion such that the notch location is subjected to tensile strain and the length of single-strand wire separates at the notch location;

wherein after separation of the length of single-strand wire, the first and second single-strand wires each present a generally tapered end corresponding to the notch location.

14. A method of separating a length of single-strand wire, as set forth in claim 13, wherein restraining the length of single-strand wire is further defined as restraining the length of single-strand wire with a first punch block portion and a second punch block portion of a punch block.

15. A method of separating a length of single-strand wire, as set forth in claim 14, wherein restraining the length of single-strand wire is further defined a restraining the length of single-strand wire with a retainer of each of the first and second punch block portions of the punch block.

16. A method of separating a length of single-strand wire, as set forth in claim 14, wherein moving is further defined as moving the first die block and the first punch block portion along the first axis relative to the second die block and the second punch block portion such that the notch location is subjected to tensile strain.

17. A method of separating a length of single-strand wire, as set forth in claim 13, wherein forming at least one notch is further defined as forming a pair of notches in the length of single-strand wire at the notch location.

18. A method of separating a length of single-strand wire, as set forth in claim 17, wherein each of the pair of notches are symmetrically opposed to one another.

19. A method of separating a length of single-strand wire, as set forth in claim 13, wherein forming at least one notch is further defined as forming at least one semi-circular notch in the length of single-strand wire at the notch location.

* * * * *